US007419288B2

(12) United States Patent
Nakaya et al.

(10) Patent No.: US 7,419,288 B2
(45) Date of Patent: Sep. 2, 2008

(54) VEHICLE LAMP WITH A FIRST REFLECTOR, A SECOND REFLECTOR, AND SHIELDING PLATE

(75) Inventors: Yoshiaki Nakaya, Tokyo (JP); Tsutomu Yamamoto, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 202 days.

(21) Appl. No.: 11/276,471

(22) Filed: Mar. 1, 2006

(65) Prior Publication Data

US 2006/0198159 A1 Sep. 7, 2006

(30) Foreign Application Priority Data

Mar. 3, 2005 (JP) ..... 2005-058994

(51) Int. Cl.
*F21V 7/09* (2006.01)

(52) U.S. Cl. ..... 362/516; 362/517; 362/518

(58) Field of Classification Search ..... 362/516–519, 362/538, 539

See application file for complete search history.

(56) References Cited

U.S. PATENT DOCUMENTS

| | | | | |
|---|---|---|---|---|
| 6,416,210 | B1 | 7/2002 | Uchida | |
| 6,419,380 | B2 * | 7/2002 | Oyama et al. | 362/517 |
| 6,431,737 | B1 * | 8/2002 | Oyama et al. | 362/516 |
| 6,575,608 | B2 * | 6/2003 | Oyama et al. | 362/517 |

FOREIGN PATENT DOCUMENTS

| | | |
|---|---|---|
| JP | 2001023419 | 1/2001 |

* cited by examiner

*Primary Examiner*—Sandra O'Shea
*Assistant Examiner*—James W Cranson
(74) *Attorney, Agent, or Firm*—Cermak Kenealy & Vaidya LLP

(57) ABSTRACT

A vehicle light can be configured to have a depth that is remarkably small. The vehicle light can include a first reflector that is an ellipse group reflector with a major/optical axis thereof inclined, a second reflector that is a parabolic group reflector located below the first reflector so that the second reflector can receive light reflected from the first reflector, and a light source located in the vicinity of the first focus of the first reflector.

17 Claims, 6 Drawing Sheets

VEHICLE LAMP WITH A FIRST REFLECTOR, A SECOND REFLECTOR, AND SHIELDING PLATE

This application claims the priority benefit under 35 U.S.C. §119 of Japanese Patent Application No. 2005-058994 filed on Mar. 3, 2005, which is hereby incorporated in its entirety by reference.

BACKGROUND OF THE INVENTION

1. Field of the Invention

The invention relates to a light used for illumination, such as a headlight, a fog light, a signal light, traffic lights, spot lights, and other lights. In more detail, the invention relates to a light for this type of illumination that has a simple configuration with a reduced number of parts and good performance characteristics.

2. Description of the Related Art

FIG. 1 shows an example of a projector type configuration for a vehicle light 90 (see, for example, Japanese Patent Laid-Open Publication No. 2001-23419 and U.S. Pat. No. 6,416,210, the disclosures of which are hereby incorporated in their entireties by reference). The vehicle light 90 includes an ellipse group reflector 91 such as a revolved ellipsoid, a light source 92, a projection lens 93, and a light shielding plate 94. The light source 92 is arranged to coincide with the first focus f1 of the ellipse group reflector 91. Therefore, light emitted from the light source 92 is converged at the second focus f2 after reflecting on the ellipse group reflector 91.

At this time, the light reflected on the lower half of the ellipse group reflector 91 enters the projection lens 93 as light having an upward facing directionality after converging at the second focus f2. When the light emits from the projection lens 93, there is also a possibility that it might include an upward facing light component which may annoy opposing vehicles.

Consequently, the light shielding plate 94, that extends to the major axis X from the lower portion of the light 90, is provided close to the second focus f2 so as to block the light reflected on the lower half of the ellipse group reflector 91. This allows only the downward facing light reflected on the lower half of the ellipse group reflector 91 to enter the projection lens 93 and, in principle, prevents upward facing light from occurring.

For the case described above, if there is absolutely no upward facing light included, it will be difficult to read road side signs such as traffic signs when they pass on the left (or right) side, for example, when driving in a country that requires traffic to proceed on a left (or right) portion of the roadway. Because of this, a process is performed on the light shielding plate 94 so as to project a moderate amount of upward facing light to the left (or right) side to make it easier to read traffic signs and verify the presence of pedestrians.

However, the conventional vehicle light 90 comprises a light source 92 arranged along the illumination direction, a lengthwise ellipse group reflector 91, a light shielding plate 94 placed near the second focus of the ellipse group reflector 91, and a projection lens 93 that has a focus near the position of the light shielding plate 94, and is assembled with all components in the lengthwise direction. Thus, the vehicle light 90 generally requires a depth of approximately 170 mm to be installed. In addition, if the necessary space for replacing the light source 92 is considered, at least 200 mm or more are required. For example, in the conventional vehicle light 90, there is a problem in which the required space inside the engine compartment increases, which influences the design of the vehicle.

SUMMARY

In view of the foregoing and other problems, one of the aspects of the disclosed subject matter is to provide a vehicle light. The vehicle light can include: a first reflector that is an ellipse group reflector with a first focus and a second focus arranged with a major axis thereof inclined so as to be positioned leaning downward with respect to the first focus; a second reflector that is a parabolic group reflector having a focus in the vicinity of the second focus of the ellipse group reflector with an optical axis in an approximate horizontal direction, the second reflector being located below the first reflector so that the second reflector can receive light reflected from the first reflector; and a light source located in the vicinity of the first focus of the first reflector.

In a vehicle light according to the above aspect, the first reflector and the second reflector may be connected at a specified position. Furthermore, a light shielding plate with an almost horizontal approximate circular arc shape may be provided at a position where the first reflector and the second reflector are connected and the light shielding plate extends from the outside diameter of the first reflector reaching to the second focus.

In a vehicle light according to the above aspect, the light shielding plate can move in the horizontal direction based on the position of the second focus.

In a vehicle light according to the above aspect, the light source may be a shape with a large length-to-width ratio and may be horizontally located along a direction perpendicular to a major axis of the first reflector.

According to this configuration, the depth of the entire vehicle light can be made remarkably small, thereby solving the problems described above as well as other problems associated with conventional vehicle lamps.

Furthermore, the configuration described above includes the first reflector, the second reflector, and the light shielding plate which are almost integrally formed. Employing the parabolic second reflector eliminates the need for a glass-made projection lens that must be made of glass and be a factor in higher costs. Thus, this configuration can simplify the composition, reduce assembling steps, reduce parts numbers, as well as lower costs.

In addition, since the light source is horizontally placed and laterally oriented with respect to a traveling axis of the vehicle and/or a longitudinal axis of the reflector body, there is no need to ensure a space for replacing the light source at the rear side of the vehicle light, thereby achieving effective use of the capacity of an engine compartment.

BRIEF DESCRIPTION OF THE DRAWINGS

These and other features and advantages will become clear from the following description with reference to the accompanying drawings, wherein.

DETAILED DESCRIPTION OF EXEMPLARY EMBODIMENTS

Figure 2:
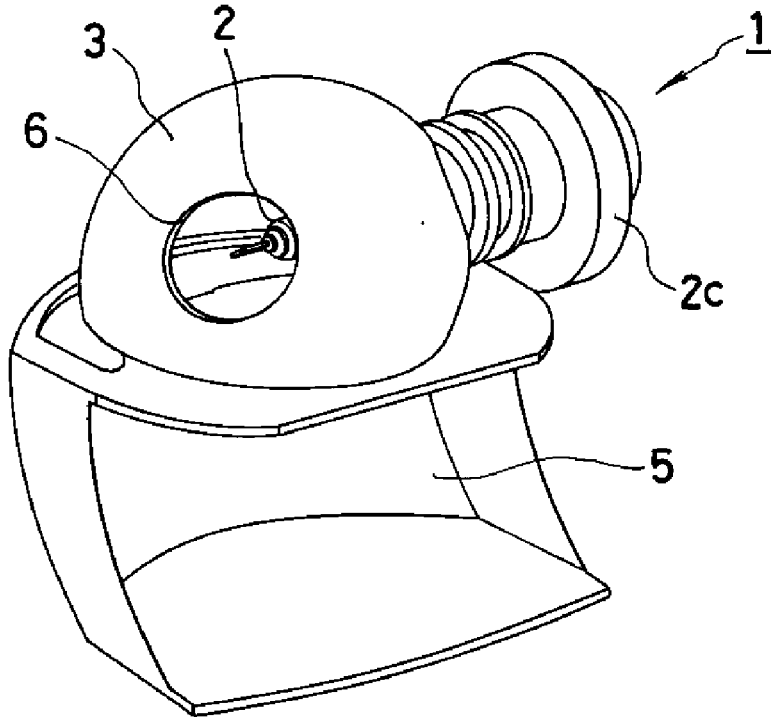
FIG. 2 is a perspective view showing an exemplary embodiment of a vehicle light made in accordance with principles of the invention.
Figure 3:
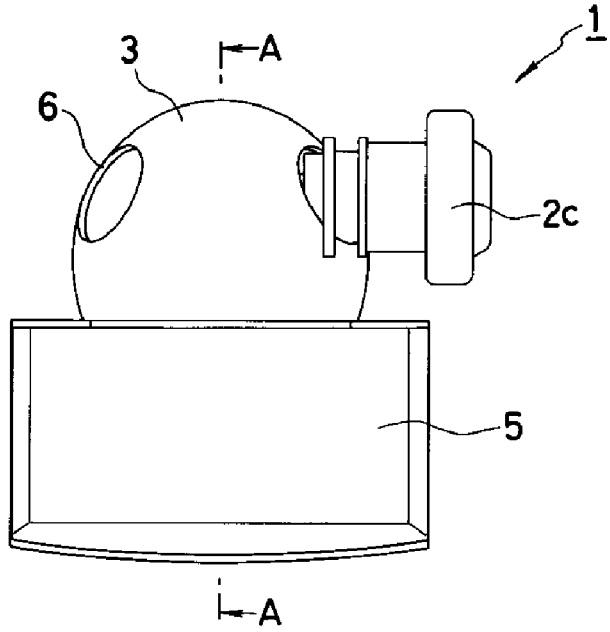
FIG. 3 is a front view of the vehicle light of FIG. 2.
Figure 4:
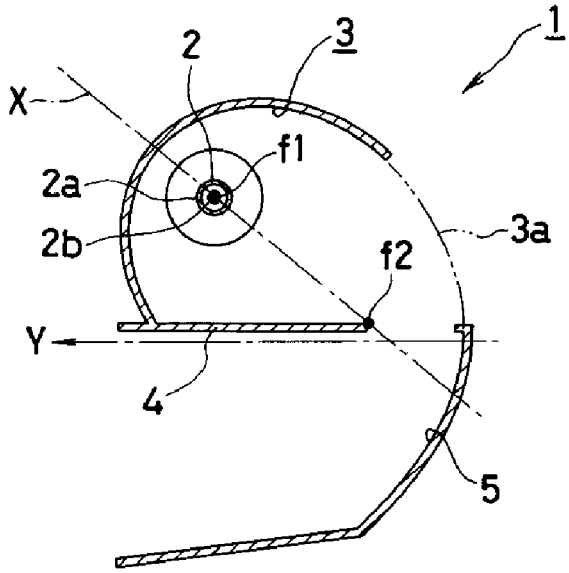
FIG. 4 is a cross-sectional view taken along line A-A of FIG. 3.

Next, exemplary embodiments of the invention will be described in detail with reference to the drawings. FIG. 2 to FIG. 4 show an embodiment of a vehicle light 1 made in accordance with principles of the invention. The vehicle light 1 can include a light source 2 such as a tungsten halogen lamp , a metal halide discharge lamp, or other lamp that has a longitudinal axis. The vehicle light 1 can also include a first reflector 3 that can be an ellipse group reflector such as a revolved ellipsoid that has a first focus in the vicinity of the light source 2, a light shielding plate 4, a second reflector 5 that can be a parabolic group reflector such as a revolved paraboloid, and an opening 6 formed close to the end of the first reflector 3.

The light source 2, for example, can be assembled by components such as a bulb 2*a*, a filament 2*b*, or a socket 2*c*. The light source 2 generally has a shape with a comparatively large length-to-width ratio, i.e., a relatively long shape from the socket 2*c* to the end of the bulb 2*a*. As shown in FIG. 4, the first reflector 3 can be configured in such a manner that the light source 2 is horizontally inserted in a direction perpendicular to the major/optical axis X of the first reflector 3 and the filament 2*b* can coincide with the first focus f1 of the first reflector 3. In other words, the light source 2 is placed laterally with respect to the vehicle light that uses a conventional ellipse group reflector.

The first reflector 3 can be arranged with an optical/major axis X facing downward approximately 45 degrees from the horizontal position. According to this arrangement, the second focus f2 of the first reflector 3 also exists at a position where it naturally moves downward by only a specified amount on the major axis X. The light shielding plate 4 can be arranged horizontally below the first reflector 3 reaching to the second focus f2.

In this state, the first reflector 3 may be cut to form a cut-away portion 3*a* at a position roughly over the second focus f2 in the approximate vertical direction, for example. Then, the light from the light source 2 is reflected by the first reflector 3, and then converged at the second focus f2 as shown in FIG. 4. The light traveling forward from the second focus f2 does not include the light that is shielded by the light shielding plate 4 as well as light that is not converged due to the cut-away portion 3*a*.

Hereupon, some of the reasons why the cut-away portion 3*a* is provided on the first reflector 3 are described in more detail. The first reflector 3 and/or the second reflector 5 (described later) are extended while the shape thereof is not changed, and when this area is closed, the light returning towards the light source 2 generates variations in the characteristics of the light source 2. Thus, there arises a problem in which the expected light distribution is not obtained. Further, when the cut-away portion 3*a* does not generate errors such as external light leakage when installed in a vehicle, it can be left open to the extent that these types of problems do not occur.

If light leakage occurs from the cut-away portion 3*a* and the aesthetic appearance is lost, the shape of the first reflector 3 will not influence the light source 2 by altering the cut-away portion 3*a*. For example, a region corresponding to the cut-away portion 3*a* of the first reflector 3 may be covered with a member having a low reflectance so as to substantially prevent any effect on the light source 2, or a suitable cover (not shown in the figure) may be attached thereto to prevent light from leaking externally and also avoid the impairment of the aesthetic appearance.

In addition to this, for example, the vehicle light can be provided with the second reflector 5 arranged in an area where the light is diffused once again after converging once at the second focus f2. The second reflector 5 can be formed as a parabolic group reflector such as a revolved paraboloid with a focus substantially coincident with the second focus f2 of the first reflector 3 and can have an almost horizontal optical axis Y. Consequently, the light from the first reflector 3 that reaches the second reflector 5 is directed towards a direction parallel to the optical axis Y, in other words, it is reflected back.

Assuming that the light source 2 provided adjacent the first reflector 3 is a point light source or a light source very close to a point light source, and the light from the light source converges on the second focus f2 in an approximate point shape. In this case, by providing the second reflector 5 as in the configuration described above, the light reflected on the second reflector 5 can be directed towards the direction of the optical axis Y of the second reflector 5 as an almost perfect parallel ray. Accordingly, a low-beam light distribution can be obtained for vehicles without any substantial upward facing light.

In reality, the light source 2 has a filament 2*b* with a surface area. Thus, when focused on the second focus f2, the light from the light source 2 has a certain amount of area (and is not a true point source of light). The focused light is reflected on the second reflector 5 again and becomes illumination light, and then the light distribution may include, for example, upward facing light. This upward facing light may be directed towards opposing vehicles which results in a possibly unsuitable shape for a low-beam light distribution for vehicles.

The above described problem may be avoided by devising a particular shape for the light shielding plate 4. In the vehicle light 1, the filament 2*b* of the light source 2 can be horizontally arranged in such a manner that the longitudinal direction of the filament 2*b* is perpendicular to the major axis X of the first reflector 3. In addition, the elliptical first reflector 3 has the second focus f2 located below. The light reflected by the first reflector 3 can further be reflected by the parabolic second reflector 5 to become illumination light. The results of trial productions and investigations by the inventors found that the outer edge of the light shielding plate 4 can be an approximate arc shape, for example, a circular arc shape, in order to form a horizontal cutoff for the illumination light.

Figure 5:
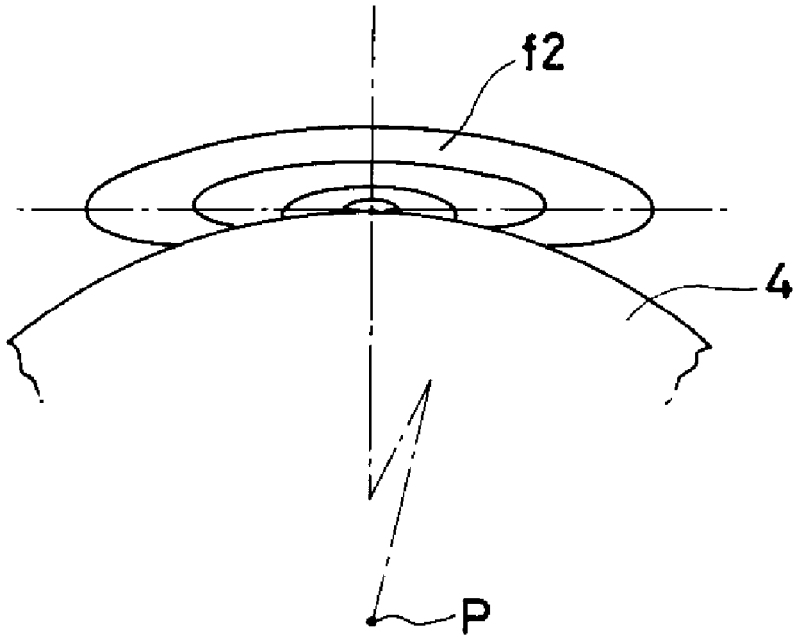
FIG. 5 is an explanatory view showing the function of an embodiment of a light shielding plate made in accordance with principles of the invention.

In other words, the light shielding plate 4 can block a part of the area of the second focus f2 of the first reflector 3 as shown in FIG. 5. At this time, the light shielding plate 4 can shield light at the position where the second focus f2 exists on the major axis X and by the approximate circular arc edge. Then, the center P of the approximate circular arc shape may exist in the first focus direction on the light shielding plate 4. Because of this, the second focus f2 may come very close to the most protruding portion of the light shielding plate 4.

Figure 6:
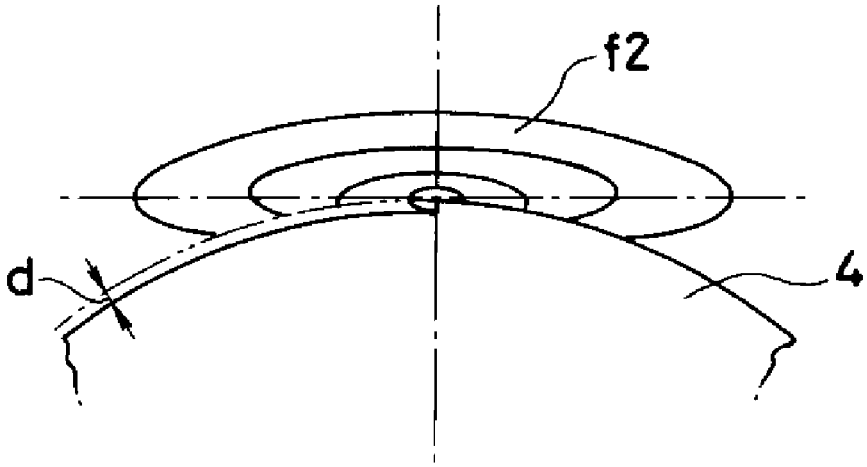
FIG. 6 is an enlarged explanatory partial view of an embodiment of a light shielding plate made in accordance with principles of the invention.

As shown in FIG. 6, when the vehicle light 1 is used for left-hand traffic, the left half portion of the level difference d is set to have a suitably smaller diameter extending from the intersection point between the major axis X and the light shielding plate 4. In this case, the quantity of light shielded by the light shielding plate 4 can change by the portion of the level difference d and the irradiated upward facing light component may increase. Namely, within the light distribution HL projected towards the front of the vehicle shown in FIG. 7, a suitable upward facing light is included in half of the left side through the second reflector 5 as shown by the dot-dash line in the figure, making it easier to read traffic signs and confirm the presence of pedestrians with the vehicle light 1. Of course, for countries in which vehicles travel on the right side of the road, the light shielding plate 4 can be configured such that the level difference d is set to have a suitably smaller diameter on a right half portion of the light shielding plate 4.

Hereupon, described in more detail, the second reflector 5 can employ a revolved paraboloid so as to project a spot shape almost as is formed at the second focus f2 by the first reflector 3 and the light shielding plate 4. Alternatively, reflector 5 can be formed as a parabolic free-form curved surface to extend the illumination width, or it can be adjusted into a shape that gathers the light quantity at the center of the light distribution to be even more suitable for travel.

Figure 8:
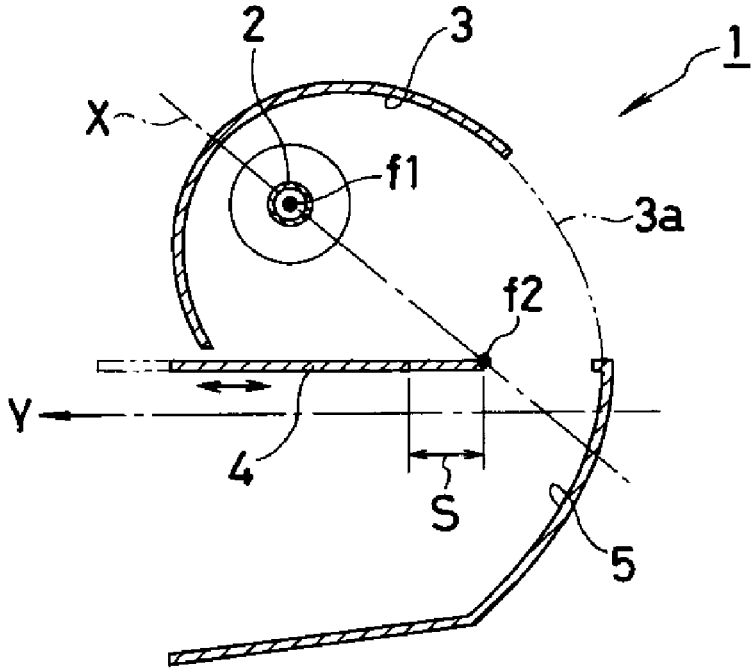
FIG. 8 is a cross-sectional view showing another exemplary embodiment of a vehicle light made in accordance with principles of the invention.

FIG. 8 shows another exemplary embodiment of a vehicle light 1 made in accordance with principles of the invention. As made clear in the previous description, in order to form a light distribution for vehicles passing each other (i.e., to form a low-beam light distribution), the light shielding plate 4 can be configured to shield a portion of the light facing upward from among the light reflected on the first reflector 3 to obtain a light distribution for vehicles passing each other which does not likely annoy drivers of opposing vehicles.

While there is no likely danger of annoying drivers of opposing vehicles while traveling on high-speed highways as well as while traveling at comparatively high speeds, it may be helpful to visually verify obstacles at greater distances. Therefore, there may be a desire for light to reach greater distances and it may be advantageous in certain circumstance to include a suitable quantity of upward facing light.

In this embodiment, in order to cope with this type of situation, the light shielding plate 4 may move horizontally forward and backward. During normal travel in urban areas, the light shielding plate 4 can be set at a position where the circular arc edge thereof almost coincides with the second focus f2 of the first reflector 3. Because of this, a light distribution for vehicles passing each other is obtained substantially without any upward facing light included in the illumination light.

In addition, when it is necessary to travel on a high-speed highway (or whenever it is desired to have more upward facing light), the light shielding plate 4 can move parallel to the direction of the optical axis Y of the second reflector 5 (or, in other words, parallel to the illumination direction of the light 1). In this configuration, a suitable interval can be provided between the end of the light shielding plate 4 and the second focus f2 of the first reflector 3. Consequently, the upward facing light previously shielded by the light shielding plate 4 passes through the interval S, reaches the second reflector 5, and is projected as upward facing irradiated light. Accordingly, the light quantity that irradiates the front of the vehicle increases, making it possible to confirm objects at even greater distances.

In the vehicle light 1, the light source 2, the first reflector 3, the light shielding plate 4, and the second reflector 5 can all overlap each other in an almost vertical direction. Consequently, compared to a conventional vehicle light, the vehicle light 1 can have an extremely small depth, for example, approximately 100 mm, making it possible to effectively use the capacity of an engine compartment.

Figure 12:
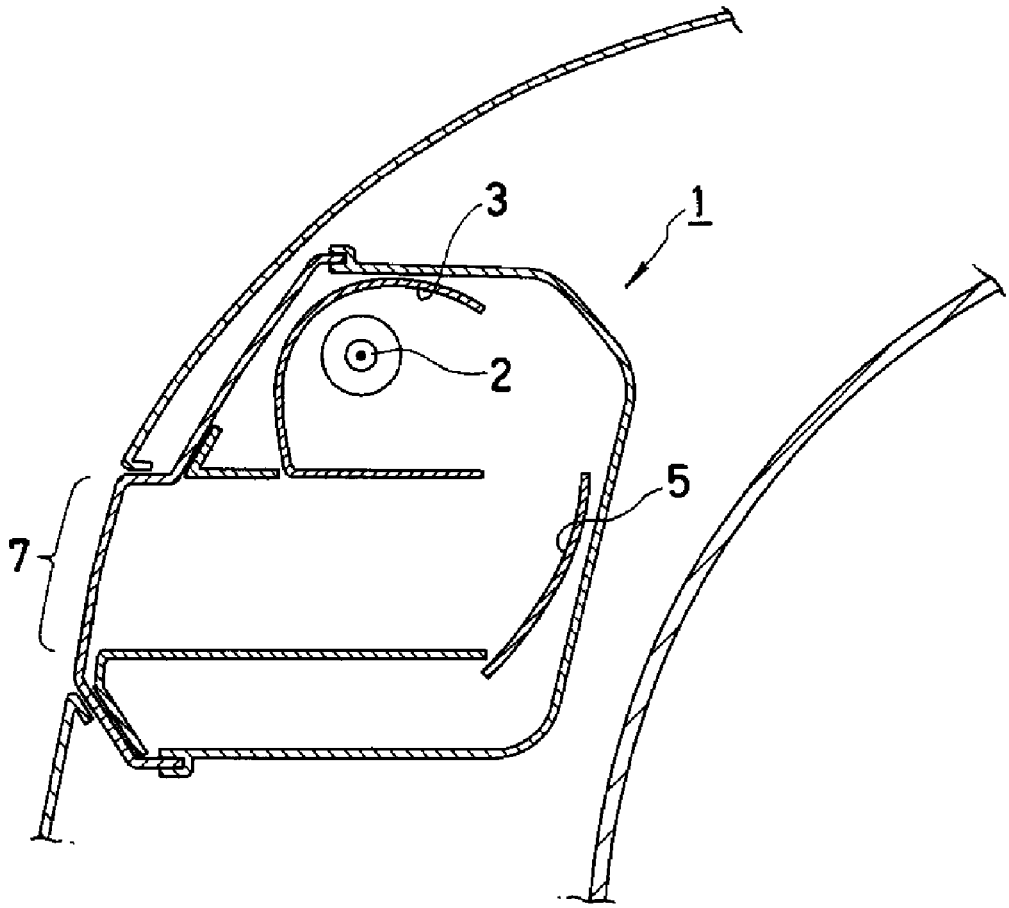
FIG. 12 is a longitudinal-section showing a state in which an embodiment of a vehicle light made in accordance with principles of the invention is installed in a vehicle.

FIG. 12 is a longitudinal-section showing an example in which a vehicle light 1 is installed in a vehicle. Because this type of vehicle light 1 is arranged with the first reflector 3 and the light source 2 overlapping in the vertical direction (direction of height of the vehicle) with respect to the second reflector 5 that irradiates light, the configuration is such that the length in the forward and rearward directions is short. Therefore, the depth when installed in a vehicle can be small.

The vehicle light 1 can include a volume of space surrounded by the first reflector 3, including the light source 2. This volume can be smaller than the volume of space from the second reflector 5 to the opening 7. Consequently, the vehicle light 1 can ensure a comparatively large opening 7 that irradiates light and obtains a predetermined quantity of light. In addition, the configuration of the vehicle light 1 can allow for a reduction in the size of the other components which do not directly irradiate light. Because of this, the vehicle light 1 makes it possible to effectively organize the limited space inside a vehicle, such as an engine compartment, and thereby allows a higher degree of freedom when designing a vehicle such as reducing the vehicle size.

Since the light source 2 is also placed laterally with respect to the first reflector 3, namely, it utilizes a system in which the light is inserted into a socket 2*c* from the side when being replaced, there is no need to provide a gap for replacing the light source 2 at the rear of the vehicle light 1. Therefore, a depth of more than approximately 100 mm is not necessary when installing the light in a vehicle. When taking into consideration replacing the light source 2, the difference between conventional technology that sometimes required equal to or more than approximately 200 mm is even greater.

Even further, since the vehicle light 1 does not necessarily use a high precision high cost glass projection lens, the problem of chromatic aberrations occurring in the light shielding plate 4 can be avoided, making it possible to reduce costs. Furthermore, it was confirmed that performance can be almost equal to that of a vehicle light that uses an ordinary projection lens (approximately 60 mm diameter) and that the light distribution can also be similar to the illustrated light distribution HL (refer to FIG. 7) in terms of efficiency and light distribution characteristics.

When a metal halide discharge lamp is utilized for the light source 2, the opening 6 shown in FIG. 2 and FIG. 3 is provided for the purpose of preventing the distance between the high-voltage section located at the end of the bulb 2*a* of the light source 2 and the first reflector 3 from becoming equal to, or smaller than, a specific value. Therefore, such an opening 6 is not required when using a halogen lamp or other lamp that does not have this type of high-voltage section.

The light shielding plate 4 can have various shapes in order to obtain the desired light distribution characteristics.

Figure 9:
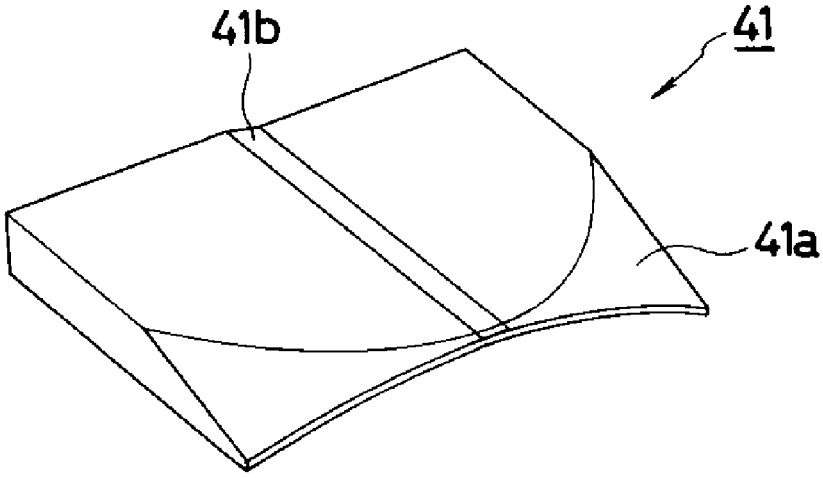
FIG. 9 is a perspective view showing the configuration of another embodiment of a light shielding plate made in accordance with principles of the invention.
Figure 10:
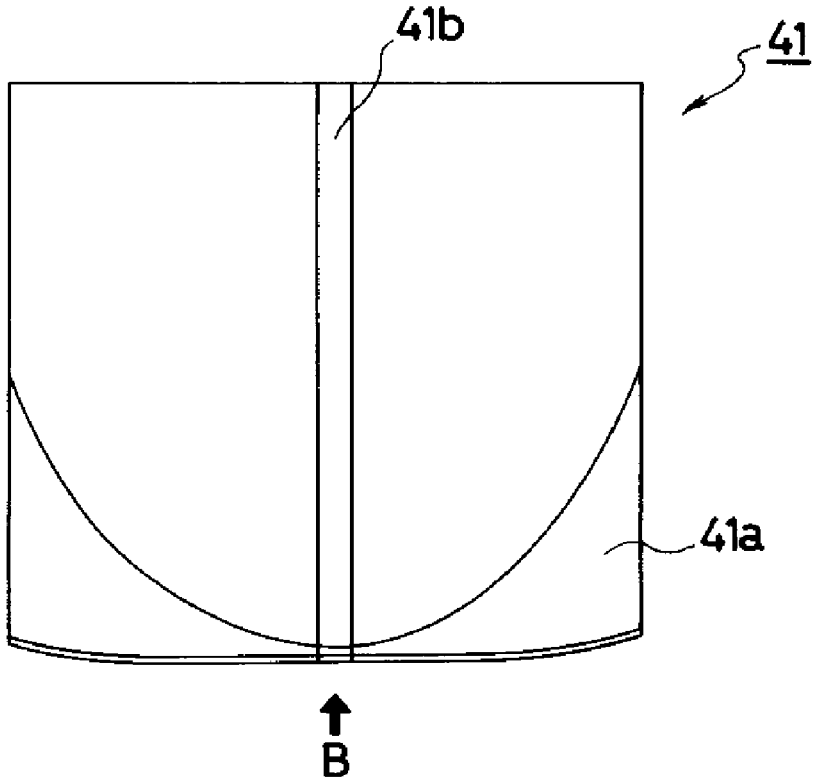
FIG. 10 is a plan view of the light shielding plate of FIG. 9.
Figure 11:
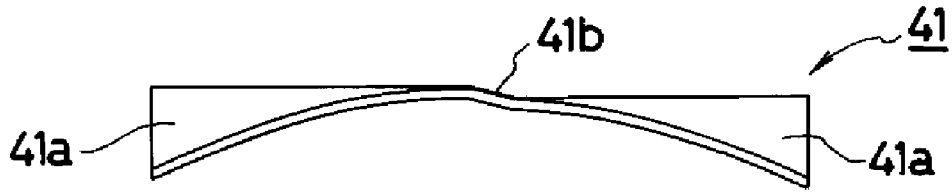
FIG. 11 is a front view of the light shielding plate of FIG. 9 as seen from the direction of arrow B in FIG. 10.

FIG. 9 is a perspective view showing an example of the light shielding plate 41 (hereinafter referred to as modified light shielding plate 41) which is modified to obtain the desired light distribution characteristics. FIG. 10 is a plan view of the modified light shielding plate 41 and FIG. 11 is a front view thereof. This modified light shielding plate 41 is composed of a three-dimensional shape to obtain an optimum light distribution for an angle of the light beam reflecting incident to the second reflector (parabolic reflector) from 0° to 90°.

Next, a method for designing the shape of the modified light shielding plate 41 will be described. This modified light shielding plate 41 can be configured so as to produce light distribution characteristics with a horizontal cut when a light beam, reflected by the first reflector 3, is emitted out of the second reflector 5 and the end 41*a* of the modified light shielding plate 41 is formed into a shape that has a curvature and a slope as shown in the perspective view of FIG. 9 and the plan view of FIG. 10.

Figure 7:
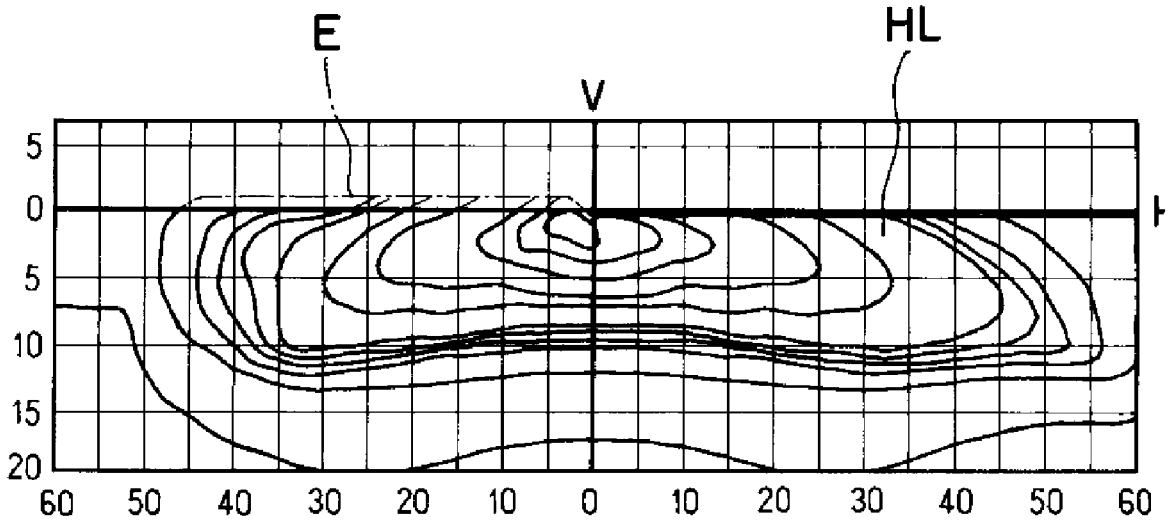
FIG. 7 is a graph showing an example of light distribution characteristics obtained by the vehicle light of FIG. 2.

In addition, if, for example, this vehicle light 1 is used as a headlight for left-hand traffic, an additional light distribution area is formed by a suitable quantity of upward facing light as an elbow area shown by the dot-dash line E in FIG. 7 in order to make it easy to read traffic signs existing on the left side of the road and confirm the presence of pedestrians. To achieve the above light distribution with the elbow area, a level difference portion 41*b* as shown in FIG. 11 can be provided on the light shielding plate 41, wherein the level difference portion 41*b* has a difference of elevation between the left half and right half.

Figure 1:
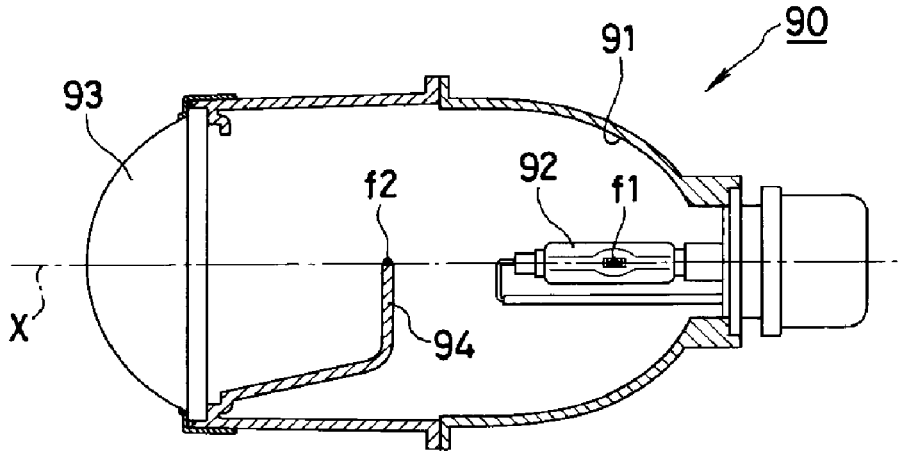
Fig. 1 Conventional Art
FIG. 1 is a cross-sectional view showing a conventional lamp.

FIG. 1 shows a housing that contains a conventional vehicle light and FIG. 12 shows an example of vehicle light 1. Note the difference in the depth between both of these vehicle light examples. This difference for vehicle light 1 makes it possible to effectively use the capacity of an engine compartment.

Although reflector 5 is shown as located below reflector 3 in the embodiment depicted in FIG. 2, it should be understood that it is contemplated that the reflector 5 be located above or on a side of the reflector 3.

While there has been described what are at present considered to be exemplary embodiments of the invention, it will be understood that various modifications may be made thereto, and it is intended that the appended claims cover all such modifications as fall within the true spirit and scope of the invention.

What is claimed is:

1. A vehicle light configured to emit light along a substantially horizontal axis, comprising;

a first reflector that is an ellipse group reflector with a first focus and a second focus;

a second reflector that is a parabolic group reflector having a focus in the vicinity of the second focus of the ellipse group reflector, with the second reflector having an optical axis extending in an approximate horizontal direction, the second reflector being located in a position adjacent the first reflector so that the second reflector can receive light reflected from the first a light source located in the vicinity of the first focus of the first reflector, wherein the first reflector and the second reflector are connected; and a light shielding plate with an arc shape portion is provided where the first reflector and the second reflector are connected, and the light shielding plate extends from an outside peripheral portion of the first reflector substantially to the second focus.

2. The vehicle light according to claim 1, wherein the light source has a shape with a large length-to-width ratio and has a longitudinal axis that is horizontally located along a direction substantially perpendicular to an optical axis of the first reflector.

3. The vehicle light according to claim 1, wherein the second reflector is located below the first reflector, and the second focus of the first reflector is located below the first focus of the first reflector.

4. The vehicle light according to claim 1, further wherein the light shielding plate is located adjacent the first reflector and has an approximately circular arc shape portion.

5. The vehicle light according to claim 1, further wherein the light shielding plate is located adjacent the first reflector, the light shielding plate includes a portion that has a level difference that creates a non-symmetrical light distribution to be emitted from the vehicle light.

6. The vehicle light according to claim 1, wherein the light shielding plate is located adjacent the first reflector, and the first reflector includes a first opening and a cutaway portion bordered by the second reflector and the light shielding plate.

7. The vehicle light according to claim 1, wherein the light shielding plate can move in a horizontal direction.

8. The vehicle light according to claim 7, wherein the light source has a shape with a large length-to-width ratio and has a longitudinal axis that is horizontally located along a direction substantially perpendicular to an optical axis of the first reflector.

9. The vehicle light according to claim 1, wherein the light shielding plate can move in a horizontal direction towards and away from the second focus.

10. The vehicle light according to claim 9, wherein the light source has a shape with a large length-to-width ratio and has a longitudinal axis that is horizontally located along a direction substantially perpendicular to an optical axis of the first reflector.

11. A light configured to emit light along a first axis, comprising:

a first reflector with a first focus and a second focus each located on an imaginary line that is configured at an angle with respect to the first axis;

a second reflector having an optical axis substantially coincident with the first axis and a focus substantially coincident with the second focus of the first reflector, the second reflector being located such that the imaginary line intersects both the first reflector and the second reflector;

a light source located substantially at the first focus of the first reflector; and a light shielding plate with an arc shape portion, the light shielding plate extending from an outside peripheral portion of the first reflector substantially to the second focus of the first reflector.

12. The light according to claim 11, wherein the first reflector is an ellipse group reflector and the second reflector is a parabolic group reflector.

13. The light of claim 11, wherein the light source is an elongate light source having a longitudinal axis that is substantially perpendicular to the first axis.

14. The light according to claim 11, wherein the light shielding plate is configured to be moveable in a direction towards and away from the second focus.

15. A vehicle light configured to emit light along a first axis, comprising:

an elongate light source that has a longitudinal axis;

means for reflecting light from the light source towards a direction substantially perpendicular to the longitudinal axis of the light source, this reflected light being first reflected light; and means for reflecting the first reflected light in a direction substantially parallel with the first axis, wherein a light shielding plate is configured to be moveable with respect to at least one of the means for reflecting light and the means for reflecting the first reflected light.

16. The vehicle light of claim 15, further comprising:

wherein the light shielding plate is located between the means for reflecting light and the means for reflecting the first reflected light, and the light shielding plate includes an edge surface formed in an arc shape.

17. A vehicle light configured to emit light along a substantially horizontal axis, comprising:

a first reflector that is an ellipse group reflector with a first focus and a second focus;

a second reflector that is a parabolic group reflector having a focus in the vicinity of the second focus of the ellipse group reflector, with the second reflector having an optical axis extending in an approximate horizontal direction, the second reflector being located in a position adjacent the first reflector so that the second reflector can receive light reflected from the first reflector; and a light source located in the vicinity of the first focus of the first reflector, wherein the light source has a shape with a large length-to-width ratio and has a longitudinal axis that is horizontally located along a direction substantially perpendicular to an optical axis of the first reflector.

* * * * *

UNITED STATES PATENT AND TRADEMARK OFFICE

CERTIFICATE OF CORRECTION

PATENT NO. : 7,419,288 B2
APPLICATION NO. : 11/276471
DATED : September 2, 2008
INVENTOR(S) : Yoshiaki Nakaya et al.

It is certified that error appears in the above-identified patent and that said Letters Patent is hereby corrected as shown below:

Col. 7 lines 41-62

Claim 1 should be corrected as follows:

1. A vehicle light configured to emit light along a substantially horizontal axis, comprising:

a first reflector that is an ellipse group reflector with a first focus and a second focus;

a second reflector that is a parabolic group reflector having a focus in the vicinity of the second focus of the ellipse group reflector, with the second reflector having an optical axis extending in an approximate horizontal direction, the second reflector being located in a position adjacent the first reflector so that the second reflector can receive light reflected from the first reflector;

a light source located in the vicinity of the first focus of the first reflector, wherein the first reflector and the second reflector are connected; and a light shielding plate with an arc shape portion is provided where the first reflector and the second reflector are connected, and the light shielding plate extends from an outside peripheral portion of the first reflector substantially to the second focus.

Signed and Sealed this

Sixth Day of October, 2009

David J. Kappos

David J. Kappos
*Director of the United States Patent and Trademark Office*